US005171934A

United States Patent [19]

Moore

[11] Patent Number: 5,171,934

[45] Date of Patent: Dec. 15, 1992

[54] SHORTENED SHOTSHELL WITH DOUBLE-CUPPED WADDING

[76] Inventor: Larry Moore, c/o Adventurer's Outpost, P.O. Box 70, Cottonwood, Ariz. 86326

[21] Appl. No.: 632,545

[22] Filed: Dec. 24, 1990

[51] Int. Cl.[5] ..... F42B 7/00; F42B 7/08

[52] U.S. Cl. ..... 102/449; 102/448; 102/532

[58] Field of Search ..... 102/448, 449, 450, 451, 102/452, 453, 532, 430, 448–463, 466, 467, 532; 86/23, 25, 29, 30, 24, 26, 27, 28, 31, 33

[56] References Cited

U.S. PATENT DOCUMENTS

| | | | |
|---|---|---|---|
| 579,853 | 3/1987 | Williams | 102/448 |
| 3,208,382 | 9/1965 | Foote et al. | 102/532 |
| 3,487,779 | 1/1970 | Hendricks | 102/532 |
| 3,656,434 | 4/1972 | Curran | 102/467 |
| 3,952,659 | 4/1976 | Sistino | 102/532 |
| 4,233,903 | 11/1980 | Lage | 102/532 |
| 4,676,170 | 6/1987 | Roster | 102/449 |
| 4,679,505 | 7/1987 | Reed | 102/449 |

FOREIGN PATENT DOCUMENTS

| | | | |
|---|---|---|---|
| 96460 | 3/1898 | Fed. Rep. of Germany | 102/532 |
| 808913 | 2/1937 | France | 102/448 |
| 1107647 | 1/1956 | France | 102/462 |
| 130152 | 7/1919 | United Kingdom | 102/448 |

OTHER PUBLICATIONS

"The Silenced QSPR Revolver" Guns & Ammo/Act 1974 page 64.

"Cartridges of the World" by Frank Barnes, 1965 284–294.

"Lyman Shotshell Handbook", First Complete Edition, 1969, pp. 35–52.

"Lyman Shotshell Handbook", 3rd Edition pp. 64–72.

*Primary Examiner*—Harold J. Tudor

[57] ABSTRACT

Shortened shotshells having a reduced length that allows one or more extra rounds to be carried in the magazine of a standard shotgun, and having substantially the same ballistic properties as standard shotshells, are obtained by using a reduced length shell casing and replacing the standard wadding with a relatively long double cup-shaped wadding with a first cup that holds the powder and a second cup to at least partly hold the shot. The open end of the first cup extends close to the primer cap. By placing the powder within the wadding and having part of the wadding extend around the shot, the same powder and shot loads may be used with a longer wadding. The longer wadding avoids tilting or tumbling of the wadding and provides a continuous gas seal between the end of the shell case and the barrel entrance across the gap that exits as a result of using the shortened shell case in a gun chambered for a standard length shell. The shortened shells with the double-cupped wadding perform well even in blow-back operated auto-loading actions.

6 Claims, 4 Drawing Sheets

PRIOR
ART

PRIOR
ART

PRIOR
ART

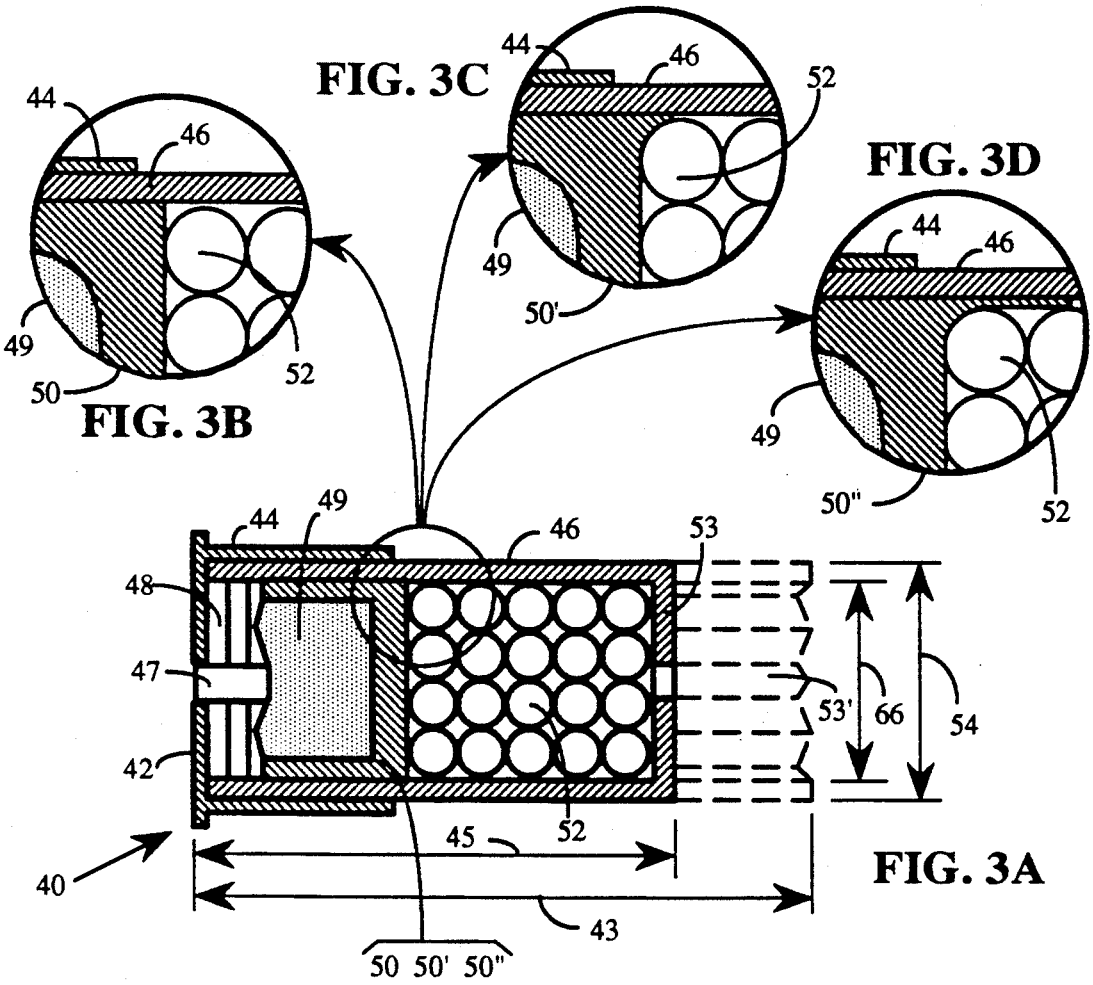
FIG. 3C
FIG. 3D
FIG. 3B
FIG. 3A
44
46
52
49
50'
50
50"
48
47
42
53
53'
66
54
45
40
43
50 50' 50"
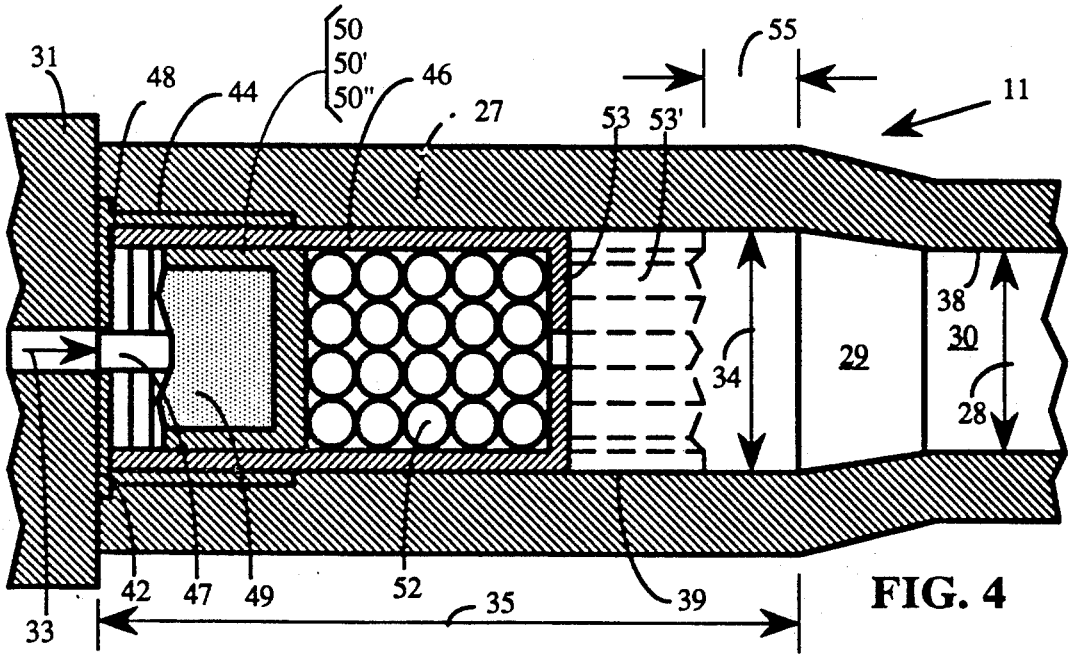
FIG. 4
31
48
44
50
50'
50"
46
27
53
53'
55
11
38
30
29
34
28
42
47
49
52
35
39
33

SHORTENED SHOTSHELL WITH DOUBLE-CUPPED WADDING

FIELD OF THE INVENTION

This invention concerns improved shotshells for use in shotguns and, more particularly, shortened shotshells that provide firing properties substantially equivalent to standard length shotshells.

Application Ser. No. 07/632,476 by Larry Moore entitled "Shortened Shotshell", filed on even date herewith related is now abandoned.

BACKGROUND OF THE INVENTION

Shotshells are widely used in shotguns for hunting, law enforcement and military combat. Since approximately the turn of the century the dimensions of shotshells have been standardized to match one or the other of a small number of standard barrel sizes. The internal barrel diameters of shotguns are usually stated in terms of "gauges", as for example, 10, 12, 16, 20 and 28 gauges. The smaller the gauge number, the larger the internal barrel diameter and the larger the shotshell diameter. The most popular gauges today are 12 and 20 gauges.

FIG. 1A shows a simplified, partial cross-sectional and cut-away view and FIG. 1B shows an end view of typical prior art shotshell 10. Shotshell 10 comprises metal base 12 having short metal sidewall 14 to which is attached paper or plastic tube or sleeve 16 which makes up most of length 13, 15 of shotshell 10. Length 13 is the length of the shotshell before sleeve 16 is crimped (i.e. rolled or folded inward to retain the powder and shot) or after the crimp unfolds on firing. Length 15 is the length of the crimped shotshell.

Base 12, sidewall 14 and sleeve 16 hold firing cap or primer 17, base wad 18, powder 19, compression wadding 20 and shot 22 in that order. Generally, the larger powder charge 19, the higher metal sidewall 14 in order to provide extra lateral (radial) strength to shotshell 10 in the immediate vicinity of the powder explosion. End 23' of sleeve 16 is inwardly folded to provide crimped end 23 to retain shot 22 in sleeve 16. Sometimes with smaller size shot or when a rolled crimp is used, a thin wad (not shown) is provided between shot 22 and crimped end 23 of sleeve 16 to insure that shot 22 is firmly retained within sleeve 16.

FIG. 2 shows a simplified, partial cross-sectional and cut-away view of prior art shotgun potion 11 with prior art shotshell 10 in place ready for firing. Shotgun portion 11 has chamber 27 for receiving shotshell 10. Inner diameter 24 of shotshell 10 is about equal to inner diameter 28 of shotgun barrel 30. Cone shaped transition zone 29 is provided between chamber 27 and barrel 30. This is referred to in the art as a "forcing cone". Chamber 27 is closed by breech 31 containing a firing pin indicated by arrow 33 aligned with primer cap 17.

Inner diameter 34 of chamber 27 matches outer diameter 36 of shotshell 10 with enough clearance so that shotshell 10 may be easily inserted and removed. Chamber 27 and breech 31 provide structural support for the relative weak casing of shotshell 10 so as resist the radial outward force created when powder 19 burns. When shotshell 10 is fired, compression wadding 20 seals against inside wall 38 of shotgun barrel 30 to propel shot 22. In this way, the full force of the rapidly expanding gases from burning powder 19 is transferred to shot 22 and little if any gas escapes around or through shot 22.

Most shotshells today come in one of two standard lengths, that is, 2.75 inches ("standard") and 3.0 inches ("magnum") and shotguns are chambered to accept either the 2.75 inch standard shells or both the 2.75 inch standard and the 3.0 inch magnum shells. A shotgun chambered for magnums will general safely fire either standard or magnum shotshells but a shotgun chambered for standard shotshells will not safely fire the longer magnum shells.

The designated "length" of shotshell 10 (e.g., 2.75 inch standard or 3.0 inch magnum) refers to length 35 of chamber 27 needed to accommodate shotshell 10 when fired, and corresponds about to overall shotshell length 13 before end 23' of sleeve 16 is crimped. Chamber length 35 must be large enough to allow crimped end 23' of sleeve 16 to completely open out against inner wall 39 of chamber 27 and provide a clear path for shot 22 and wad 20 to pass out of sleeve 16 and into barrel 30. If sleeve end 23 cannot fully open, then a constriction is created partially blocking barrel entrance 29. This can lead to excessive pressure and possible rupture of the chamber or breech.

A standard 2.75 inch shotshell has uncrimped length 13 of about 2.75 inches and crimped length 15 of typically about 2.375–2.5 inches. When shotshell 10 is fired, crimped end 23 unfolds against wall 39 of chamber 27, restoring the shell to approximately uncrimped length 13. Length 35 of chamber 27 is sufficient to accommodate uncrimped shotshell length 13 between breech 31 and forcing cone entrance 29 to barrel 30, leaving at most very small gap 25 therebetween. The close proximity of unfolded shell end 23' and forcing cone 29 allows shot 22 and wadding 20 to pass smoothly from sleeve 16 into barrel 30 so that the wadding can make a substantially gas-tight seal against interior wall 38 of barrel 30.

The 2.75 inch "standard" length for shotshells dates back to the days when such shells used black powder. Because black powder was a comparatively weak explosive, a substantial volume of black powder was necessary to propel the shot from the shotgun with sufficient force to be effective. Thus, a relatively long shell casing was required to accommodate the volume of black powder needed. The 2.75 inch shotshell length was adopted by many gun manufacturers of that era because it was able to hold the desired amount of black powder and they chambered their shotguns accordingly. This became the de-facto standard that persisted long after the use of black powder was discontinued, and still remains the standard today. While most new guns are chambered for both 2.75 inch standard and 3.0 inch magnum shotshells, the 2.75 inch standard shotshell is still the predominant shell type because of the very large number of existing guns chambered for that shell length which cannot safely use the 3.0 inch magnum shell.

Once black powder was replaced by modern smokeless power in the early 1900's, the large volume of space in the 2.75 inch standard shell length was no longer needed for the powder charge because the smokeless powder was much more powerful. The empty space could not be filled with smokeless powder because that would create a grave risk of gun rupture, especially with older guns designed for use with black powder. Whether or not any attempt was ever made to shorten the shell casings without modifying the gun chamber is lost in the history of gun and ammunition development near the beginning of the present century. If such attempts were made they were apparently unsuccessful and the standard 2.75 inch shell length was retained and the excess space in the shell filled by additional wadding or shot cups or other space-takers. Even today, almost a century after smokeless powder came into widespread use, virtually all shotguns are still manufactured to accept the 2.75 inch standard shell length in their chambers and magazines.

Many shotguns are of the manual (pump) or semiautomatic (gas or blow-back operated) repeating variety. Because shotshells are relatively large, they are usually held end-to-end in tubular magazines mounted under the barrel. Clip-type magazines where shells are held side-by-side are generally not used with shotguns because they are too bulky.

The number of shells that a tubular magazine can accommodate is limited by the free magazine length divided by the shell length. Some extra space is provided in the tubular magazines to accommodate the coiled spring that pushes the shells out of the magazine as the loading action is cycled.

Most shotgun magazines hold four 2.75 inch standard shells. An additional round may be held in the chamber, giving a typical maximum load of five shells. Extended magazines, which are common on military and police shotguns, may hold five to ten shells giving a total of six to eleven shells, but further lengthening of the tubular magazine is not desirable because it makes the shotgun unwieldy.

While five shells may be adequate for most hunting situations, in law enforcement and military combat there is a great premium on having as many shells as possible in the magazine. This is because shotguns are slow and awkward to reload in high stress, fire-fight situations. The tubular magazine must be refilled one shell at a time. Where two opposing combatants (e.g. police versus criminal or soldier versus soldier) are armed with shotguns, the one with one or more extra rounds in his weapon has a great advantage, a potentially life saving advantage.

Despite the desirability of being able to carry more shotshells in a standard shotgun magazine, little progress has been made since the first tubular magazine shotguns were introduced in the early part of the century. The shotshell and magazine length of most shotgun designs have remained virtually unchanged. If anything, newer forms of ammunition have tended to be longer (e.g., the magnum shell) which decreases the effective magazine capacity. Thus, a long unsatisfied need exists for shotshells which permit a larger magazine load and which fire safely and effectively without weapon modification.

SUMMARY OF THE INVENTION

It is an object of the present invention to provide an improved means and method for shotshells of reduced length that allow at least one additional shell to be fitted within a standard length magazine, as for example, five shortened shells in the space of four standard prior art shells or six in the space of five, or ten in the space of eight, etc., and which fire safely and effectively without weapon modification, especially in conventional existing shotguns of all types, including pump repeaters, semi-automatic gas operated and semi-automatic blowback operated shotguns.

It is a further objective to provide an improved means and method for shortened shotshells able to contain pellet and powder loads and provide ballistic performance substantially similar to conventional prior art standard length shotshells, despite their reduced length.

These and other objects and advantages are realized by a shortened shotshell comprising, a shotshell casing including a base for retaining a primer cap and a hollow tubular member extending away from the base for retaining powder and shot, and a double-cupped wadding located between the powder and the shot. The wadding has a first open end providing a first cup or cavity of a first depth facing the primer for containing a majority of the powder and a second open end providing a second cup or cavity of a second depth facing the shot and for containing part of the shot. The overall length of the shotshell is reduced so that at least five of the above described shotshells fit in substantially the same length occupied by four standard shotshells while still providing a wadding length sufficient to prevent tilting or tumbling of the wadding between the end of the shotshell casing and the barrel entrance and to provide a substantially continuous gas-tight seal between the end of the shotshell case and the barrel entrance to minimize gas blow-by. The wadding can be made of compressed paper or of molded or machined plastic. Molded plastic is preferred.

It is further desirable that the cavities be wider near their open ends than near their bottoms. It is also desirable that the primer cap have an interior end (for igniting the powder) which extends substantially to the open end of the first cavity.

In a preferred embodiment, the wadding has a substantially cylindrical outer shape of a predetermined diameter adapted to fit the bore of the shotgun in which the shotshells will be used. The first cavity contains the powder and its sidewall and the partition between it and the second cavity must withstand the gas pressure within the shotgun chamber and barrel without rupture.

The second cavity is intended to partly enclose one or more rows of shot and should have a depth at least about equal the shot radius minus, optionally, a small clearance amount depending on the wall thickness of the second cavity. The purpose of the second cavity is to add length to the outer wall of the wadding so that it can bridge the gap between the end of the shotshell casing and the barrel without permitting any significant gas blow-by, that is, the outer wall of the wadding should be long enough so that its forward end (formed by the wall of the second cup partly around the shot) enters the barrel while the aft end (formed by the wall of the first cup around the powder) is still within the shell casing. In this way, a continuous substantially gas-tight seal is maintained and gas blow-by is substantially prevented without depending on radial expansion of the wadding to contact the interior wall of the gun chamber.

In a preferred embodiment, the wadding has an overall length of about at least about 0.495 to 0.625 inches plus the radius of the shot intended to be used, less a small (e.g. 0.005–0.01 inch) clearance amount, typically at least about 0.625 inches. For example, "00-buckshot", which is commonly used in police and military loads, has a radius of about 0.165 inches, giving an overall wadding length of about 0.65 inches. Longer waddings obtained by means of deeper second cavities can also be used provided there is sufficient radial clearance within the shotshell casing to accommodate both the wall of the second cavity and the shot. Where there is not sufficient radial clearance within the shell casing, it is preferable to have the depth of the second cavity be less than the shot radius.

The first cavity depth is usefully about 0.25–0.5 inches, preferably about 0.35 to 0.4 inches and typically about 0.35 inches. The partition between the two cavities is preferably about 0.1 to 0.2 inches, typically about 0.15 inches thick. The outer diameter of the wadding is chosen so that it can fit within the hull of the shotshell and engage the shotgun bore for which the shells are intended, and will vary with the bore size and shotshell diameter. For a 12 gauge shotshell, the wadding has a diameter preferably in the range 0.725 to 0.735 inches, typically about 0.73 inches.

It is further desirable that the wadding cavities have tapered sidewalls whose thicknesses increase toward the bottoms of the cavities. This facilitates radial distension of the end portion of the first sidewall near the first open end when the shotshell is fired so that it seals tightly against the inner wall of the shell casing and shotgun barrel without rupture. The tapered second sidewall allows it to extend into the otherwise empty space between the first row of shot and the inner wall of the shotshell casing created by the curvature of the shot. Further, the sidewall tapers provide a greater sidewall thickness where they meet the closed portion of the wadding which separates the two cavities, thereby increasing the wadding strength to avoid rupture. A taper angle of 5–15 degrees and a sidewall skirt thickness at the end of the first cavity of about 0.01–0.02 inches is suitable. A sidewall rim thickness at the end of the second cavity of about 0.005 inches or more is suitable.

The above described shortened shotshell is made by a method comprising, providing a shotshell case having a base and an open end and a length between the base and open end such that, after closure of the open end, five shortened shotshells fit in the same length occupied by four standard shotshells, then introducing into the shotshell casing a wadding having therein back-to-back cavities separated by a solid partition where a first cavity faces the base for substantially containing most of the shotshell powder and a second cavity, for example, about one shot radius deep faces the shot, introducing the shot into the casing between the wadding and the open end so that the forward rim of the wadding around the second cavity extends between part of at least the first row of shot and the interior casing wall, and closing the open end of the casing to retain the shot. It is desirable that the step of introducing the wadding include introducing a substantially cylindrical wadding having a predetermined length and diameter as explained above.

It further desirable that the step of providing the casing include providing a casing having a primer cap extending into the casing with an end interior to the casing for igniting the powder, and that the step of providing the wadding comprises inserting the wadding into the casing until the interior end of the primer cap extends substantially to the first opening in the wadding.

By placing the powder inside the wadding and having the first end of the wadding extend deep into the base of the shell near the primer firing hole and by having the second end of the wadding extend at least into the space around the first row of shot created by the shot curvature, a long wadding is obtained despite the reduced shell length and without any significant reduction in the shot or powder load.

Having a long wadding is important. It maintains a smooth transition from shotshell sleeve to barrel entrance despite the increased separation that arises from shortening the shotshell. Unless the wadding is long enough to bridge this gap gas blow-by can occur, adversely affecting the shot pattern and muzzle velocity. With the present invention a near perfect gas seal is maintained, tilting and tumbling of the wadding is avoided and the shot pattern and muzzle velocity of the shortened shotshell are substantially the same as the standard shotshell for the same shot and powder loads. Further, the shotshell employing the double-cupped wadding fires satisfactorily in a greater variety of weapons, including blow-back operated auto-loaders, providing more reliable auto-loading. These are important features and advantages of the invented design.

As used herein the word "shotshell" is intended to refer to a cartridge containing powder, wadding, and shot, slug or projectile of any kind, for use in a shotgun or other firearm. The word "wadding" is intended to refer to a device, made of any material (e.g., cloth, paper, plastic and combinations thereof), located between the powder and shot of a shotshell for sealing against the interior of a shotgun barrel when the shotshell is fired so as to prevent substantial gas leakage past the wadding. The word "wad" is used generally to refer to any spacer or padding or the like that may be located anywhere within the shotshell casing, e.g., at the base end between the base and the powder or at the shot end to retain the shot or elsewhere. As used herein the word "round" in the context of a cartridge, shell or bullet is intended to refer to a shotshell. The foregoing definitions are intended to apply to these words in singular or plural form.

BRIEF DESCRIPTION OF THE DRAWINGS

FIG. 3A shows a simplified cross-sectional and partially cut-away view of a shortened shotshell according to the present invention, and FIGS. 3B–D show enlarged portions thereof according to different embodiments of the present invention;

FIG. 4 shows a simplified cross-sectional and partially cutaway view of the shotshell or FIG. 3 installed and ready for firing in the same prior art shotgun as illustrated in FIG. 2;

DETAILED DESCRIPTION OF THE PREFERRED EMBODIMENT

Figure 1A:
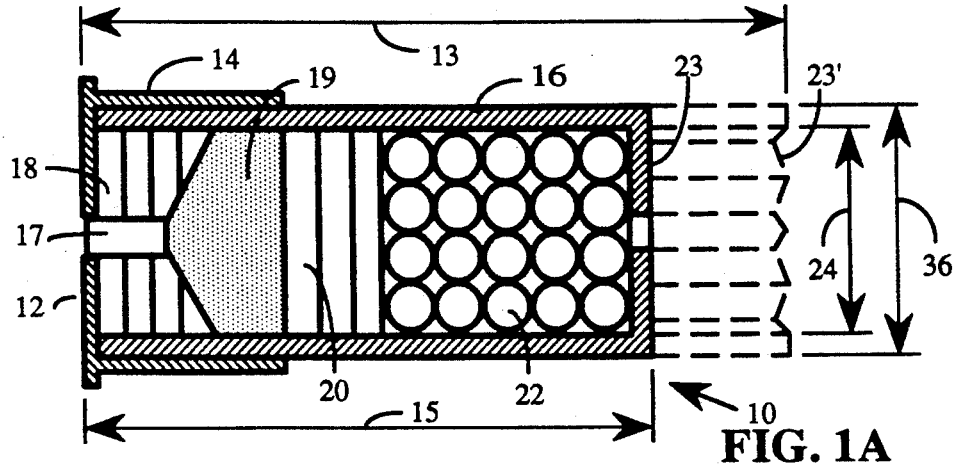
FIG. 1A shows a simplified cross-sectional and partially cut-away view and FIG. 1B shows an end view of a typical shotshell according to the prior art.
Figure 1B:
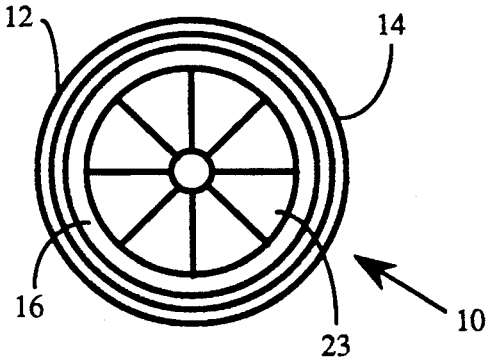

A standard shotgun magazine intended to hold four 2.75 inch standard shotshells has a clearance space of about ten inches. This clearance space allows for some variation in the typical 2.375–2.5 inch crimped length of the standard 2.75 inch shotshell. In order to accommodate five shortened shells in the same space, each shortened shell should be about 10/5=2.0 inches. To accommodate reasonable manufacturing variation, the crimped length of a shortened shotshell should be typically in the range of 1.9–2.0 inches and preferably not much over 2.0 inches.

A standard shotshell can be shortened by making the internal waddings or other space-takers shorter or by decreasing the powder and/or shot load or both. For example, if the total length of wadding in the shell (measured along the direction of fire) is reduced by approximately 0.375–0.5 inch, then the overall shell casing length can be reduced by about the same amount to give the desired 1.9–2.0 inch shell length (crimped). Shells made in this manner have the desired length but poor ballistic properties. Tests showed that reduced length shells made with shortened wadding had highly variable muzzle velocity (e.g., up to 25% variation) and erratic shot patterns. This was true even though substantially the same powder and shot loads were used as for conventional length shells.

It was determined that the degradation in ballistic properties of these reduced length shells employing shortened waddings is due to gas blow-by and tilting or tumbling of the short wadding during the brief time when the short wadding is the gap between the unfolded end of the shortened shell casing and the barrel entrance. With a shortened shell (e.g., 2.0 inch crimped, 2.375 inch uncrimped length), there is a gap of at least 0.375 inches between the end of the unfolded shell casing and the barrel entrance in a gun chambered for conventional 2.75 inch length shells and 0.875 inches in a gun chambered for 3.0 inch shells. When the short wadding is in this gap, the wadding is unconstrained by either the sleeve, chamber or barrel walls and there is nothing to prevent gas blow-by around the wadding. The turbulent gas blow-by causes the wadding to tilt or tumble.

Figure 2:
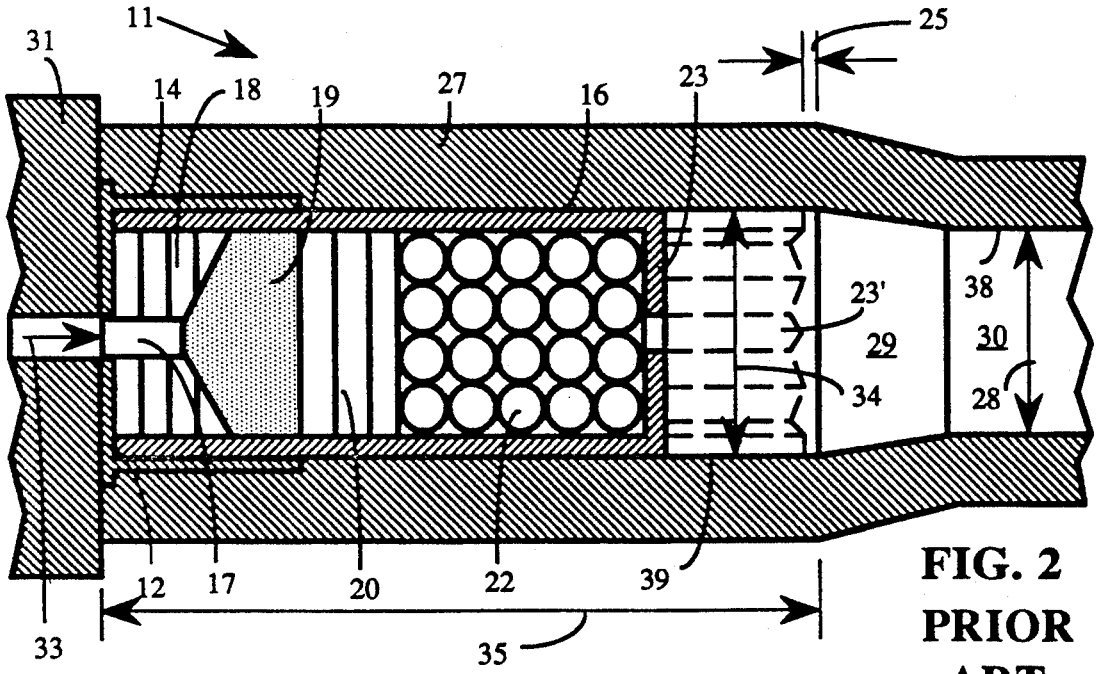
FIG. 2 shows a simplified cross-sectional and partially cutaway view of the shotshell of FIGS. 1A–B installed in the chamber of a typical prior art shotgun.

Prior art waddings fired from shortened shells were carefully examined and found to have scuff marks created when the wadding entered the barrel slightly tilted or off center. Such scuff marks are not observed with conventional standard length shells because gap 25 (see FIG. 2) between the end of the standard shotshell sleeve and the barrel entrance is small compared to the standard wadding length and the forward end of the wadding begins to enter the barrel before the following end of the wadding has exited the sleeve. This prevents blow-by and tilting or tumbling of the wadding from the conventional shotshell. With reduced length shotshells and correspondingly shortened prior art waddings, this smooth transition is not possible and poor ballistic performance results.

It was discovered that the foregoing and other problems are avoided and reduced length shotshells of excellent ballistic performance obtained if the interior construction of the shotshell is changed so that a long wadding is provided while still maintaining space for about the same powder and shot load. This was accomplished by making the wadding hollow, that is, with a double-cup shape, with the open end of the first cup facing the primer for substantially containing the powder and an open of the second cup facing and at least partially containing the shot.

Figure 5:
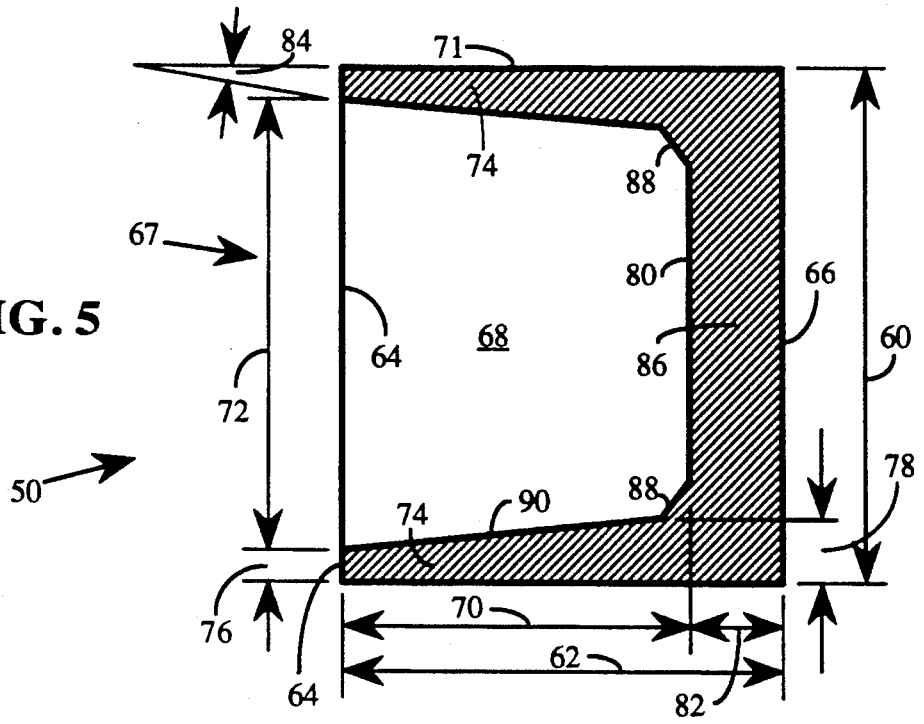
FIG. 5 shows a simplified cross-sectional view of an improved wadding and FIGS. 6–7 show opposed end views of the wadding of FIG. 5.
Figure 6:
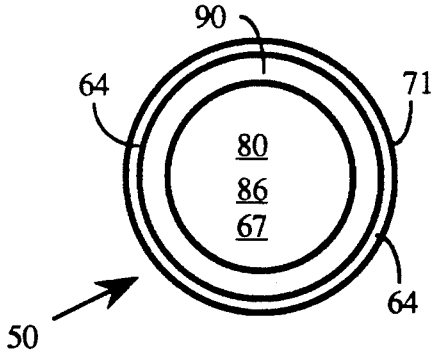
Figure 9:
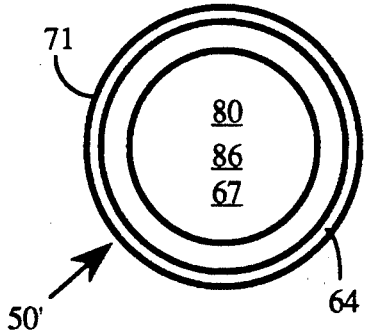
FIG. 8 shows a simplified cross-sectional view and FIGS. 9–10 show opposed end views similar to FIGS. 5–7 but of a further improved wadding according to a further embodiment of the present invention.
Figure 7:
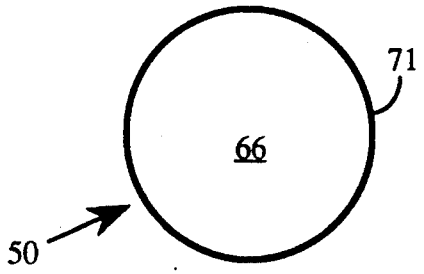
Figure 10:
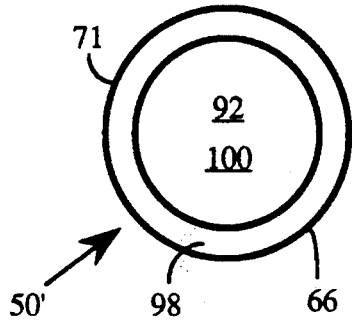
Figure 8:
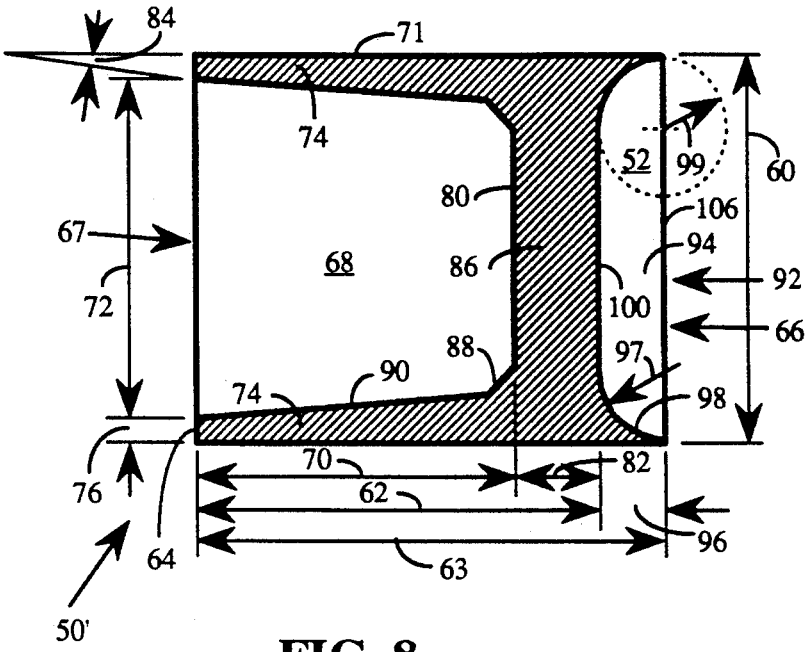
Figure 11:
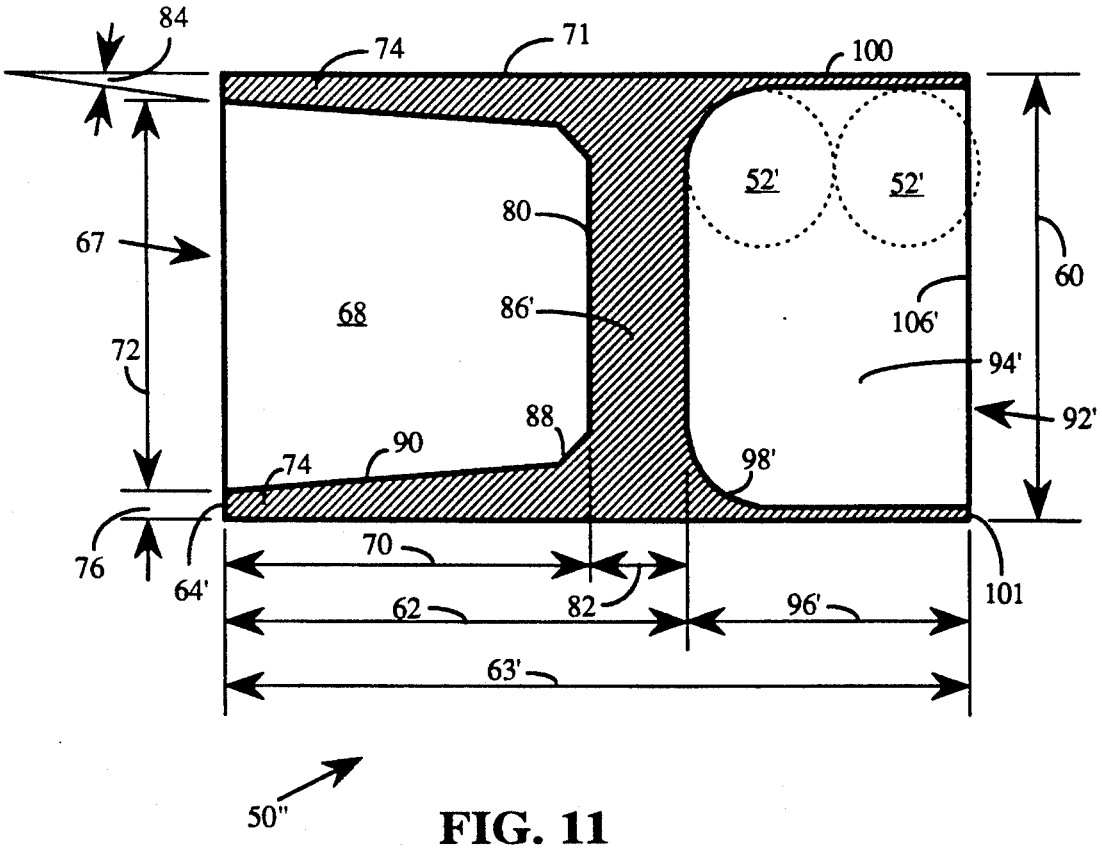
FIG. 11 shows a simplified cross-sectional view similar to FIG. 8 but according to a still further embodiment of the present invention..

FIG. 3A shows a simplified cross-sectional and partially cut-away view of shortened shotshell 40 according to the present invention and with FIGS. 3B–D showing enlarged portion according to different embodiments. FIG. 4 shows the same shotshell 40 installed and ready for firing in conventional shotgun portion 11, the same as in FIG. 2. FIG. 5 shows a simplified cross-sectional view of the wadding of the present invention in greater detail, FIG. 6 shows a view of the end of the wadding which faces the primer and FIG. 7 shows a view of the end of the wadding which faces the shot, according to a first embodiment. FIGS. 8–10 are similar to FIGS. 5–7. but according to a further embodiment and FIG. 11 shows a still further embodiment.

Referring now to FIGS. 3a–4, improved shotshell 10 comprises base 42 with sidewall 44 and sleeve 46 analogous to prior art shotshell 10, but with shortened overall length 43 and crimped length 45. Overall (uncrimped) length 43 is, typically, about 2.375 inches and crimped length 45 is typically about 1.9–2.0 inches.

The maximum crimped length 43 is determined by the desire to fit at least one extra shell into a standard magazine length, e.g., five rounds in a conventional four round magazine, six rounds in a five round magazine, ten rounds in an eight round magazine, and do forth. As has been explained above, this leads to a crimped length of about two inches for most guns. Based on the description herein, those of skill in the art will understand how to choose the length of a crimped round, and from that determine the length of the same round when uncrimped, depending on the amount of crimp needed to retain the shot. The larger the shot, the less crimp is needed. The larger the gauge, the more crimp that can be used, i.e., the greater the shell diameter, the more sleeve length that can be folded in to close the end of the shell. For simplicity of manufacture, it is desirable to use a single uncrimped shell length suitable for obtaining the desired 1.9–2.0 inch crimped length for each gauge even though different size shot may be inserted therein. For 12 gauge shortened shells, an uncrimped shell length of about 2.375 inch is preferred.

Shotshell 40 has therein firing primer 47, base wad 48, powder 49, wadding 50 and shot 52 in that order. Sleeve 46 has rolled or crimped end 53 analogous to end 23 of shotshell 10. Shotshell 40 has outer sleeve diameter 54 and inner diameter 66 substantially the same as diameters 36, 24 respectively, of prior art shotshell 10. The parts and dimensions of shotgun portion 11 of FIG. 4 are the same as in FIG. 2 and the same reference numbers are used in FIG. 4. However, due to the smaller length 43, 45 of shortened shell 40, much larger gap 55 now exists between unfolded end 53 of sleeve 46 of shotshell 40 and forcing cone 29 at the entrance to barrel 30 of shotgun 11.

Referring now to FIGS. 3B and 5–7, wadding 50 is, in the preferred embodiment, of substantially cylindrical outer shape of diameter 60 and length 62. Wadding 50 has end 64 facing toward powder 49 and end 66 facing toward shot 52. End face 64 of wadding 50 has opening 67 forming cavity 68 therein of depth 70 and diameter 72 near end face 64. Sidewall 74 separates cavity 68 from the substantially cylindrical outer surface 71 of wadding 50.

It is desirable that sidewall 74 be tapered so as to have thickness 76 near end face 64 and thickness 78 near cavity bottom 80. Wadding end portion 86 of thickness 82 separates cavity bottom 80 from end face 66. Sidewall 74 has taper angle 84.

For a twelve gauge shotgun shell, wadding diameter 60 is preferably about 0.725–0.735 inches, typically about 0.73 inches, wadding length 62 preferably about 0.495–0.625, typically about 0.5 inches, thickness 82 of end portion 86 preferably about 0.1–0.2 inches, typically about 0.15 inches, thickness 76 of sidewall 74 at open end face 64 preferably about 0.01–0.03 inches, typically about 0.02 inches, cavity depth 70 usefully about 0.25 to 0.5 inches, preferably about 0.30–0.45 inches, typically about 0.35 inches, and taper angle 84 preferably about 5–15 degrees, typically about 10 degrees. It is desirable that cavity sidewall 74 be thicker where it intersects end portion 86 and that intersection 88 of cavity bottom 80 and interior cavity wall 90 be chamfered or rounded.

It is important that the wadding not rupture when the shell is fired, otherwise gas leakage results. Thus, sidewall 74 and end portion 86 should be thick enough and strongly joined enough to resist the force of the gases generated by burning powder 49. The tapered sidewall which is thicker at the bottom of the cavity than at the open end, and the chamfered or rounded intersection between the cavity bottom and interior wall, each contribute to preventing wadding 50 from rupturing during firing.

Tapered sidewall 74 has a further advantage of permitting end 64 of wadding 50 to expand radially, that is by increase in diameter 72, so that the portion of exterior wadding surface 71 near end 64 can make a gas-tight seal against the interior wall of shell casing 46 and interior wall 38 of barrel 30. To the extent that end 64 of wadding 50 can expand without rupture into larger diameter 34 of chamber 27 in gap 55 once it leaves sleeve 46 and before it enters forcing cone 29 and barrel 30, gas blow-by in gap 55 is reduced. Having sidewall 74 taper to a comparatively thin edge width 76 at end 64 facilitates this. Inspection of wadding 50 after firing from shortened shotshells 40 showed that end 64 of wadding 50 had expanded radially to a bell-like shape, i.e., diameter 72 had increased while diameter 60 remained substantially unchanged, and without rupture of the wadding. This indicates that wadding 50 is expanding radially to provide at least some sealing action against inner wall 39 of chamber 27 in gap 55.

The wadding can be made of compressed paper or of molded or machined plastic. Materials used for conventional prior art molded plastic waddings are suitable provided that they are not too hard or rigid. Molded high density polyethylene is preferred. It is desirable that the skirt of the wadding adjacent the cavity opening be sufficiently elastic to expand into chamber 27 and/or forcing cone 29 without rupture so as to improve gas sealing.

Tests made on twelve gauge shortened shotshells of the above described construction and dimensions, and of a length that allowed five to fit in the space of four or six in the space of five, etc., gave excellent performance compared to standard shells with conventional powder and shot loads, that is, substantially similar muzzle velocity and shot patterns. The ballistic performance of the shortened shotshell is substantially the same as an equivalently loaded standard 2.75 inch shell.

Shortened shotshell 40 is made by a method comprising, providing shotshell case 44, 46 having base 42 and open end 53' and length 45 between base 42 and open end 53' such that, after folding in end 53' to provide crimped end 53, five shortened shotshells 40 fit in the same length occupied by four closed standard shotshells 10, then introducing into shotshell casing 44, 46 wadding 50 having therein opening 67 forming cavity 68 facing base 42 for substantially containing most of shotshell powder 49, introducing shot 52 into casing 44, 46 between wadding 50 and open end 53', and forming crimped end 53 to retain shot 52. It is desirable that the step of introducing wadding 50 include introducing substantially cylindrical wadding 50 having predetermined length 62 and diameter 60, wherein diameter 60 is chosen so as to closely engage bore 38 of shotgun 11 for which shells 40 are intended, and wherein length 62, cavity depth 70, end wall thickness 82, sidewall thickness 76 and taper angle 84 have the magnitudes previously described.

It further desirable that the step of providing the casing include providing casing 44, 46 having primer cap 47 extending into base 42 and casing 44, 46 with an end interior to casing 44, 46 for igniting powder 49, and that the step of providing wadding 50 comprises inserting wadding 50 into casing 44, 46 until the interior end of primer cap 47 extends substantially to opening 67 of wadding 50.

The above-described shortened shotshell of the present invention having the wadding design illustrated in FIGS. 5–7 was tested successfully in a variety of shotguns, as for examples, the models 870 and 1100 manufactured by the Remington Arms Company of Ilion, N.Y., the model 1200 manufactured by the Winchester Arms Company of Hew Haven, Conn., and the model 37 manufactured by the Ithaca Arms Company of Ithaca, N.Y. and others.

Difficulties were encountered with the shotshell and wadding design of FIGS. 5–7 in only two gun models, the model 500 manufactured by the Mossberg Arms Company of Northhaven, Conn. and the model Super 90 manufactured by the Benelli Arms Company of Urbino, Italy. With the first, the shortened shells did not transfer properly from the magazine to the chamber because their reduced length permitted them to fall through a slot in the loading mechanism of that gun model. In the second, the reduced length shells sometimes failed to eject properly. The Benelli Super 90 utilizes a blow-back operated auto-loading mechanism, whereas the other auto-loaders tested are all of the gas operated variety. These were the only difficulties encountered in a large number of firing tests with many different guns.

It was further discovered that the failure to consistently eject in blow-back operated auto-loaders, such as for example, the Benelli Super 90, could be overcome by the wadding design illustrated in FIGS. 3C–D and 8–11.

The wadding of FIGS. 3C–D and 8–11 differs from the wadding of FIGS. 3B and 5–7 in that it has a second opening 92, 92' forming second cavity 94, 94' of depth 96, 96' in end face 66. Rim portion 98, 98' of cavity 94, 94' is curved or angled so as to fit up around shot 52. Rim portion 98 desirably has a radius of curvature 97 about equal to radius of curvature 99 of shot 52.

While rim portion 98, 98' is shown as being curved, which arrangement is preferred, it may consist of one or more conical segments. The exact shape of rim portion 98 may vary so long as it extends into the otherwise empty space left between the first row of spherical shot closest to face 100 of wadding 50' and the inner wall of sleeve 46 in which wadding 50' and shot 52 are inserted. This small annular space has an inward facing curvature determined by the radius of curvature of the shot and an outer perimeter determined by the diameter of the inner cylindrical wall of sleeve 46. By utilizing this otherwise empty space, the length of wadding 50' is increased by amount 96 without any increase in the length of shotshell 40 or decrease in shot or powder load. This additional length helps insure that end 106 of wadding 50' begins to seat against barrel entrance 29 before end 64 of wadding 50 leaves sleeve 46 of reduced length shotshell 40. This minimizes the possibility of gas blow-by and pressure loss when wadding 50 is transiting gap 55. This leads to more consistent shell ejection and reload cycling in blow-back operated semi-automatic shotguns, which are apparently more sensitive to slight gas leaks than are gas operated auto-loaders.

For the wadding depicted in FIGS. 3C 8–10 sized for use in a twelve gauge shell, dimensions 60, 62, 70, 72, 76, 82 and 84 are similar to those described for the embodiment shown in connection with FIGS. 5–7. Overall wadding length 63 is equal to length 62 of first cavity 68 and partition 86, plus depth 96 of second cavity 94. Depth 96 is preferably at least equal to radius 99 of shot 52. "OO-buckshot" for example, has a radius of 0.165 inches, but larger or smaller shot may also be used. While rim 106 of wadding 50', i.e., the skirt of cavity 94, is shown as tapering to a knife edge, it desirably has a small radial thickness parallel to diameter 60 of about 0.003–0.01 inches, typically about 0.005 inches. This is desirable to avoid crumpling of rim 106 of wadding 50' when it encounters barrel entrance 29.

FIGS. 3D and 11 are simplified cross-sectional views through wadding 50'' according to a further embodiment of the present invention. The end views of wadding 50'' of FIG. 11 are similar to FIGS. 9–10. Wadding 50'' differs from wadding 50' in that cavity 94' is much deeper so rim 106' of wadding 50' extends much further up around shot 52', enclosing one or more rows of shot. This further increases overall length 63' of wadding 50'', because second cavity depth 96' is not limited by the radius of the shot. This arrangement is possible when there is sufficient space inside shotshell sleeve 46 to accommodate shot 52 and sidewall 101 of wadding 50'. Sidewall 101 of wadding 50'' is desirably tapered to curve around shot 52 near partition 86' and has a thickness at rim 106 of at least 0.005–0.01 inches or more. As depth 96' is increased it is desirable to increase the thickness of sidewall 101 at rim 106' so as to avoid sidewall crumpling on impact with the barrel entrance. If depth 96' is sufficient to enclose all of the rows of shot, rim 106' may curve radially inward slightly to facilitate entrance into barrel 30. With this arrangement, wadding length may be increased to 0.875 inches or more so as to completely bridge the gap between sleeve end 53' and barrel entrance 29 even in guns chambered for magnum shells.

Shortened shotshell 40 is made by a method comprising, providing shotshell case 44, 46 having base 42 and open end 53 and length 45 between base 42 and open end 53' such that, after closure of open end 53', five shortened shotshells 40 fit in the same length occupied by four closed standard shotshells 10, then introducing into shotshell casing 44, 46 wadding 50', 50'' having therein first opening 67 forming first cavity 68 facing base 42 for substantially containing most of shotshell powder 49 and second cavity 94 for partly containing shot 52, introducing shot 52 into casing 44, 46 between wadding 50', 50'' and open end 53', and providing closed end 53 to retain shot 52. It is desirable that the step of introducing wadding 50', 50'' include introducing substantially cylindrical wadding 50', 50'' having predetermined length 63, 63' and diameter 60, wherein diameter 60 is chosen so as to closely engage bore 38 of shotgun 11 for which shells 40 are intended, and wherein length 63, 63' is as described above.

It further desirable that the step of providing the casing include providing casing 44, 46 having primer cap 47 extending into base 42 and casing 44, 46 with an end interior to casing 44, 46 for igniting powder 49, and that the step of providing wadding 50', 50'' comprises inserting wadding 50', 50'' into casing 44, 46 until the interior end of primer cap 47 extends substantially to opening 67 of wadding 50', 50''.

By placing powder 49 substantially inside wadding 50', 50'' and having open end 67 of wadding 50', 50'' extend deep into base 42 of the shell 44, 46 near the primer firing hole, and having second cavity 94, 94' extend partly around shot 52, a longer wadding 50', 50'' may be used despite the reduced shell length 43 and without any significant reduction in the shot or powder load.

Having a long wadding 50', 50'' is important. It maintains a smooth and substantially gas-tight transition from shotshell sleeve 46 to barrel entrance 29 despite gap 55 that arises from shortening shotshell 40. Forward rim 106, 106' of longer wadding 50', 50'' enters barrel 30 before trailing edge 64, 64' of wadding 50', 50'' leaves unfolded end 53' of sleeve 46. Thus, no gas blow-by can occur even though gap 55 exists with the shortened shell casing. The long wadding also prevents wadding tilt or tumble before reaching barrel 30. The combination of no wadding tilt/tumble and substantially no gas blow-by because of the sleeve-to-barrel sealing action of the longer wadding 50', 50'' provides improved shortened shotshell performance. Good ballistic properties are obtained and erratic shell ejection is eliminated in blow-back operated gun actions.

While the above-mentioned dimensions are preferred for twelve gauge applications, the same principles apply to shotshells of other gauges. In general, the length dimensions remain the same since the shell lengths are the same for the different gauges. The diameters or width dimensions are scaled to fit the desired gauge, i.e., made larger to fit within the shell casing and barrel for a ten gauge gun or smaller to fit within the shell casing and barrel for a twenty gauge gun, and so forth. Persons of skill in the art will understand how to choose the particular width dimensions or diameters of the cup-shaped wadding required for such other gauges.

Having thus described the invention, those of skill in the art will appreciate that the shortened shotshell of the present invention permits at least one additional shell to be contained within the magazine of a conventional weapon without modification of the weapon magazine or chamber, that the shortened shotshells of the present invention fire safely and effectively and with substantially no decrease in ballistic performance as compared to equivalently loaded shells of conventional length, and that the shortened shotshells of the present invention are easy and convenient to manufacture with only a change of the shell sleeve length combined with a unique wadding of increased length obtained by placing the powder in a first cavity whose wall extends into close proximity with the firing primer and, placing at least part of the shot in a second opposed cavity the rim of whose wall extends into the space around the radius of at least the first row of shot thereby further extending the length of the wadding, whereby the long wadding substantially eliminates gas blow-by which would otherwise occur due to use of a shortened shell in a conventional length chamber.

While the present invention has been described in terms of particular materials and shapes, as for example, a plastic wadding with a first cavity facing the powder and primer and a second cavity facing the shot, and having an elongated substantially cylindrical outer shape and tapered sidewalls between the interiors of the cavity or cavities and the outer cylindrical surface, those of skill in the art will appreciate that other shapes, dimensions and materials could be used without departing from the spirit of the present invention provided that the resulting wadding-sleeving combination provides a shell short enough to permit at least one extra round to fit in the magazine, and when the shell is fired, has a wadding flexible enough to seal against the inside of the sleeve and barrel, strong enough to withstand the force of the expanding gases, and long enough to substantially eliminate gas blow-by and avoid tilting or tumbling of the wadding in the gap between the shortened shell casing and the barrel entrance. Accordingly, it is intended to include such variations as will occur to those of skill in the art based on the description herein in the claims that follow.

What is claimed is:

1. A shortened shotshell having a closed length of about two inches and a predetermined open length, and ballistic properties comparable to an equivalently loaded standard length shotshell of the same gauge when fired in a gun having a chamber length which accepts the standard length shotshell, comprising:

a shotshell casing comprising first and second opposed ends and a base at the first end retaining a primer cap and a hollow tubular member extending away from the base toward the second end retaining powder and shot in an amount comparable to the standard length shell, and wherein the predetermined open length of the shortened shotshell is the distance between the first and second ends with the second end is open;

a wadding located between the powder and shot and having first and second open ends spaced apart predetermined length and a closed partition therebetween wherein the first end contains a first cavity of a first depth facing the primer cap containing a majority of the powder, and wherein the second end contains a second cavity containing a part of the shot; and wherein the length of the wadding is at least about 0.495 inches plus about a radius of the shot and wherein the closed partition has a thickness of about 0.1–0.2 inches.

2. A shortened shotshell having a closed length of about two inches and an open length and having ballistic properties substantially comparable to an equivalently loaded standard length shotshell of the same gauge when fired in a gun having a chamber length for accepting the standard length shotshell, comprising:

a base receiving a firing primer;

a tubular sleeve extending away from the base containing powder, wadding and shot, the powder and shot in an amount substantially equal to that in the standard length shotshell; and a wadding of double-cup shape and of a predetermined length of about 0.495–0.625 inches plus about a radius of the shot and located in the sleeve so that a first open end of a first cup faces the firing primer and a second open end of a second cup faces the shot, wherein the first and second cups are arranged bottom to bottom with a solid partition therebetween, and wherein the powder is substantially contained within the first cup and only a portion of the shot is within the second cup.

3. The shotshell of claim 2 wherein the wadding has tapered sidewalls forming both cup shapes, wherein the sidewalls are thinner near their open ends than near their bottoms.

4. The shotshell of claim 3 wherein the taper angle of a first sidewall is about 5–15 degrees.

5. The shotshell of claim 2 wherein the second cup has a depth less than a depth of the first cup.

6. The shotshell of claim 2 wherein the second cup has a curved peripheral portion which has a radius of curvature substantially equal to a radius of the shot.

* * * * *